US008156750B2

(12) United States Patent
Butorac et al.

(10) Patent No.: US 8,156,750 B2
(45) Date of Patent: Apr. 17, 2012

(54) DYNAMIC SUPERHEAT CONTROL FOR HIGH EFFICIENCY REFRIGERATION SYSTEM

(75) Inventors: John Michael Butorac, Kettle Falls, WA (US); Timothy Thomas Pearson, Fergus Falls, MN (US)

(73) Assignee: Agri Control Technologies, Inc., Fargo, ND (US)

( * ) Notice: Subject to any disclaimer, the term of this patent is extended or adjusted under 35 U.S.C. 154(b) by 740 days.

(21) Appl. No.: 12/181,423

(22) Filed: Jul. 29, 2008

(65) Prior Publication Data

US 2010/0024455 A1 Feb. 4, 2010

(51) Int. Cl.
*F25B 41/04* (2006.01)

(52) U.S. Cl. ..... 62/225; 62/205

(58) Field of Classification Search ..... 62/199, 62/200, 204, 205, 225; 700/276
See application file for complete search history.

(56) References Cited

U.S. PATENT DOCUMENTS

| | | | | |
|---|---|---|---|---|
| 2,367,305 | A | 1/1945 | Newton | |
| 3,390,540 | A | 7/1968 | Brush | |
| 4,523,435 | A | 6/1985 | Lord | |
| 5,007,245 | A | 4/1991 | Defenbaugh et al. | |
| 5,035,119 | A * | 7/1991 | Alsenz | 62/225 |
| 5,109,676 | A * | 5/1992 | Waters et al. | 62/117 |
| 5,263,333 | A * | 11/1993 | Kubo et al. | 62/160 |
| 5,276,630 | A * | 1/1994 | Baldwin et al. | 700/276 |
| 5,402,652 | A | 4/1995 | Alsenz | |
| 5,551,248 | A | 9/1996 | Derosier | |
| 5,771,703 | A | 6/1998 | Rajendran | |
| 5,867,998 | A | 2/1999 | Guertin | |
| 6,449,968 | B1 * | 9/2002 | Singh et al. | 62/175 |
| 6,530,236 | B2 | 3/2003 | Crane et al. | |
| 6,769,264 | B2 | 8/2004 | Moon et al. | |
| 6,854,285 | B2 * | 2/2005 | Jessen | 62/225 |
| 6,938,433 | B2 | 9/2005 | Bash et al. | |
| 6,951,117 | B1 | 10/2005 | Wightman | |
| 6,983,618 | B2 * | 1/2006 | Singh et al. | 62/217 |
| 7,290,398 | B2 | 11/2007 | Wallace et al. | |
| 2004/0093879 | A1 * | 5/2004 | Street et al. | 62/151 |
| 2006/0162358 | A1 | 7/2006 | VanderZee | |
| 2007/0186569 | A1 * | 8/2007 | Street et al. | 62/132 |

FOREIGN PATENT DOCUMENTS

WO WO 2007094343 A1 * 8/2007

OTHER PUBLICATIONS

Machine Translation_WO2007094343A1.pdf.*

* cited by examiner

*Primary Examiner* — Cheryl J Tyler
*Assistant Examiner* — Paolo Gonzalez
(74) *Attorney, Agent, or Firm* — Marsh Fischmann & Breyfogle LLP

(57) ABSTRACT

A vapor compression refrigeration system including components capable of determining the superheat at a compressor inlet is provided. The vapor compression refrigeration system may include sensors capable of making measurements from which the superheat at the compressor inlet may be determined. The vapor compression refrigeration system may be operable to compare the determined superheat level at the inlet to the compressor to a desired superheat level and generate a new evaporator discharge superheat level target for one or more evaporators operatively interconnected to the compressor to affect the superheat at the compressor inlet. The vapor compression refrigeration system may be operable to broadcast the new evaporator discharge superheat level target to the one or more evaporators over a communications bus. The vapor compression refrigeration system may update and broadcast the evaporator discharge superheat level target at programmed intervals.

11 Claims, 3 Drawing Sheets

DYNAMIC SUPERHEAT CONTROL FOR HIGH EFFICIENCY REFRIGERATION SYSTEM

FIELD OF THE INVENTION

The present invention generally relates to vapor compression refrigeration systems and, more particularly to vapor compression refrigeration systems operable to dynamically control superheat levels at various points within the system.

BACKGROUND OF THE INVENTION

A typical vapor compression refrigeration system includes one or more evaporators disposed within a space to be cooled, a condenser disposed outside of the space to be cooled, a compressor for circulating a working fluid between the evaporator and the condenser, and expansion valves located between the condenser outlet and the inlet to each evaporator. The compressor compresses the working fluid in the form of vapor that is then circulated through the condenser where it is cooled and condensed to a liquid. The working fluid is then expanded through the expansion valve to reduce the pressure and to flash the working fluid into a liquid/vapor mixture. This mixture is then circulated through the evaporator.

In the evaporator, the working fluid absorbs heat from the space to be cooled and evaporates and is heated to become a superheated vapor. A superheated vapor is vapor at a temperature higher than the saturation temperature for a particular pressure. Prior vapor compression refrigeration systems have usually been designed to control the expansion valve to provide a large safety margin of superheat to avoid introducing liquid working fluid into the compressor. The introduction of liquid into the compressor may damage the compressor. The large safety margin has been required to accommodate, for example, variations in cooling load, ambient conditions at the condenser, system response times, and measurement inaccuracies.

SUMMARY OF THE INVENTION

A first aspect of the present invention is embodied by a method of operating a vapor compression refrigeration system. A level of superheat at the inlet to a compressor of the vapor compression refrigeration system is determined, and the determined level of superheat at the inlet to the compressor is compared to a compressor inlet superheat target. A revised evaporator superheat target is calculated and is at least partially based on the noted determined superheat level/compressor inlet superheat target comparison. An evaporator output superheat level at an output to an evaporator of the vapor compression refrigeration system is adjusted based on the revised evaporator superheat target. This adjustment may be in the form adjusting an expansion valve associated with the evaporator.

A second aspect of the present invention is embodied by a method of operating a vapor compression refrigeration system. A level of superheat at the inlet to a compressor of the vapor compression refrigeration system is determined. At least part of the system is monitored for an occurrence of a first condition, where the first condition is the compressor inlet superheat level being out of compliance with a compressor inlet superheat target. An evaporator output superheat level at an output to an evaporator of the vapor compression refrigeration system may be adjusted in response to this monitoring. In an embodiment of the second aspect, a signal may be sent or issued upon each occurrence of an identified first condition and the noted adjustment may be made in response to the issuance of such a signal.

A number of feature refinements and additional features are separately applicable in relation to each of the above-noted first and second aspects of the present invention. These feature refinements and additional features may be used individually or in any combination in relation to each of the first and second aspects. That is, each of the following features that will be discussed are not required to be used with any other feature or combination of features unless otherwise specified.

Any appropriate working fluid may be used in relation to the first and second aspects. All references to "superheat" may be the superheat of this working fluid at the designated location in the vapor compression refrigeration system. Superheat levels may be determined or acquired in any appropriate manner. For instance, a superheat level at a given locale may be calculated using the output of one or more sensors, one or more properties of the working fluid, or any combination thereof. Any "superheat target" utilized by the first and/or second aspects may be of any appropriate value or combination of values (e.g., a specified range; a variance from a particular superheat target value, where the variance may be expressed as a percentage or in degrees of superheat). In one embodiment the compressor inlet superheat target is less than 25 degrees F. of superheat. In one embodiment, the compressor inlet superheat target may be between 15 and 25 degrees F. of superheat. The compressor superheat target may be maintainable within a 2 degree window disposed about a particular superheat target value.

The compressor inlet superheat level may be different from the evaporator output superheat level, even though the compressor may be the next major component of the vapor compression refrigeration system that is downstream from the evaporator (e.g., working fluid flows from the evaporator to the compressor). For instance, the evaporator and compressor may be spaced by a relatively significant distance. Therefore, the first and second aspects may each entail determining a superheat level at the inlet to the compressor. In one embodiment, the superheat level is determined using data acquired at a point about 12 inches from the compressor inlet. In one embodiment, the superheat level is determined using data acquired within about 12 inches of the compressor inlet (and thereby encompassing using data acquired within the compressor inlet). In one embodiment, the superheat level is determined at two locations between the compressor and each of its evaporators, and the superheat level that is used to initiate an adjustment of the operation of each associated evaporator is the superheat level that is closest to the compressor inlet.

In an embodiment, the method may further include calculating a difference between the determined level of superheat at the inlet to the compressor and a compressor inlet superheat target. The calculated difference may be used to determine a revised evaporator superheat target. For example, the revised evaporator superheat target may be at least partially based on a previous evaporator superheat target and the calculated difference.

The comparison of the compressor inlet superheat level to the compressor inlet superheat target in the case of the first aspect and the monitoring for an occurrence of a first condition in the case of the second aspect each may be undertaken in any appropriate manner and on any appropriate basis. For instance, the current compressor inlet superheat level may be compared to the compressor inlet superheat target at one or more predetermined times (e.g., on periodic basis, such as hourly; in accordance with a predetermined schedule, including where at least part of the schedule may be periodic, where at least part of the schedule may be non-periodic, or any combination thereof). Any adjustment or combination of adjustments may be made to change the evaporator output superheat level. In one embodiment, the evaporator output superheat level is adjusted by adjusting an expansion value that controls the flow of working fluid into the evaporator.

Each adjustment to the evaporator output superheat level may be for purposes of attempting to change the compressor inlet superheat level in a desired manner, for instance to at least reduce the magnitude of any variance between the compressor inlet superheat level and the compressor inlet superheat target. Any appropriate signal(s) or communication(s) may be utilized to initiate an adjustment to the evaporator output superheat level. For instance, the signal/communication could embody information of a desired evaporator output superheat level or of a desired incremental adjustment to the evaporator output superheat level, which in turn is used to generate an appropriate control signal for the evaporator. Such a signal/communication could also be in the form of a control signal that is used to control the operation of the evaporator. In any case, these types of signals/communications may be directed to one or more components of the vapor compression refrigeration system over a communications bus of any appropriate type.

In an embodiment, the method may further include sending a revised evaporator superheat target to an evaporator controller. The adjustment of the evaporator output superheat level may be performed by an electronic evaporator controller. In an embodiment, the vapor compression refrigeration system includes a plurality of evaporators that are each in fluid communication with a common compressor. In this regard, method may further include performing the adjusting step for each of a plurality of evaporators, where each evaporator may have an associated expansion valve, a fan, and an electronic evaporator controller. The adjusting step may comprise broadcasting a revised evaporator superheat target to the plurality of electronic evaporator controllers.

The method of operating the vapor compression refrigeration system may include varying a capacity of the compressor. The operation of the compressor may include floating the discharge and/or suction pressures of the compressor. The operation of each evaporator associated with the compressor may include varying a speed of a fan associated with each of the evaporators.

In an embodiment, the method may include performing the determining, adjusting and other appropriate steps a plurality of times during a day to compensate for variations in ambient conditions during the day. At least a portion of the steps may be performed in an automated fashion.

A third aspect of the present invention is embodied by a vapor compression refrigeration system that includes a communications bus, a plurality of evaporator subsystems, a compressor, a compressor inlet sensor, a compressor controller, and a condenser. The plurality of evaporator subsystems may each include an evaporator, an evaporator controller communicatively attached to the communications bus, an expansion valve controllable by the evaporator controller, and an evaporator discharge sensor interconnected to the evaporator controller and operable to measure one or more parameters that are associated with or indicative of the evaporator discharge superheat. The compressor inlet sensor may be operable to take a measurement at a compressor inlet such that a compressor inlet superheat level may be determined from the measurement. The compressor controller may be communicatively attached to the communications bus (e.g., in operative communication with) and be operable to broadcast an evaporator superheat target to the plurality of evaporators. The compressor controller may be operable to determine the evaporator superheat target at least partially based on the compressor inlet superheat level and a target inlet superheat for the compressor. In an embodiment of the third aspect, the compressor controller may be a slave controller.

A fourth aspect of the present invention is embodied by a vapor compression refrigeration system that includes a communications bus, an evaporator subsystem, a compressor subsystem, compressor inlet superheat determination logic, and compressor inlet superheat comparison logic. The evaporator subsystem may include an evaporator and an evaporator controller in operative communication with the communications bus. The compressor subsystem may include a compressor and a compressor inlet sensor. The compressor inlet superheat determination logic may be operatively interconnected with the compressor inlet sensor (e.g., to accommodate communications therebetween in at least one direction). The compressor inlet superheat comparison logic may be operatively interconnected with the compressor inlet superheat determination logic (e.g., to accommodate communications therebetween in at least one direction) and may include a compressor inlet superheat target. The compressor inlet superheat comparison logic may be in operative communication with the evaporator controller through the communications bus.

A number of feature refinements and additional features are separately applicable in relation to each of the above-noted third and fourth aspects of the present invention. These feature refinements and additional features may be used individually or in any combination in relation to each of the third and fourth aspects. That is, each of the following features that will be discussed are not required to be used with any other feature or combination of features unless otherwise specified. Initially, the vapor compression refrigeration systems of the third and fourth aspects may be configured to execute each of the methods embodied by the above-discussed first and second aspects. Each of the third and fourth aspects may incorporate each of the various features discussed above in relation to the first and/or second aspects, individually and in any combination.

The communications bus may be of any appropriate configuration and/or type. Any appropriate communication technology or combination of communication technologies may be utilized by the communications bus. What is of importance is for the vapor compression refrigeration system to accommodate the various communications addressed herein (e.g., between various of its components).

The compressor inlet sensor may be of any appropriate size, shape, configuration, and/or type. Multiple compressor inlet sensors may be utilized. The output from at least one compressor inlet sensor may be utilized by the compressor inlet superheat determination logic to determine the compressor inlet superheat in any appropriate manner (e.g., based upon any such output, alone or in combination with one or more properties of a working fluid being utilized by the system). In one embodiment, the compressor inlet sensor includes a pressure transducer and a temperature measurement device.

The fourth aspect may include a plurality of evaporator subsystems disposed in any appropriate arrangement, and each of which may fluidly communicate with a common compressor. In an embodiment, each evaporator subsystem may include a variable speed fan. In an embodiment, the compressor may be a variable capacity compressor.

Multiple compressors may be utilized by the vapor compressor refrigeration system. One or more evaporator subsystems may be associated with each compressor. A signal or communication to affect a change in the evaporator output superheat may be broadcast to all evaporator subsystems over the communications bus, although each such signal/communication may embody information so that only the evaporator subsystem(s) associated with a particular compressor are adjusted to change their respective evaporator output superheat level. For instance, each such signal/communication may be encoded so that only the evaporator subsystems that are associated with the compressor (that is the source of the signal/communication) will respond to such a signal/communication.

The vapor compression refrigeration system may include a plurality of evaporator controllers, and each of the evaporator controllers may be operable to selectively ignore a broadcast of a superheat output set point from an unselected source. The unselected source may be an additional compressor controller communicatively attached to the communications bus. In an embodiment, at least a portion of the plurality of evaporator controllers may be slave controllers.

In an embodiment, the vapor compression refrigeration system may further include a master computer communicatively attached to the communications bus. The master computer may be operable to receive and store data from the various controllers and/or components of the vapor compression refrigeration system. The data may include operational parameters obtained from the various controllers and/or components of the vapor compression refrigeration system. The vapor compression refrigeration system may further include a web server module operatively interconnected to the master computer. In this regard, the data may be accessible from remote locations through the web server module. Furthermore, aspects of the vapor compression refrigeration system may be remotely controlled or adjusted through the web server module.

Any logic that is utilized by the third and/or fourth aspects may be implemented in any appropriate manner, including without limitation in any appropriate software, firmware, or hardware, using one or more platforms, using one or more processors, using memory of any appropriate type, using any single computer of any appropriate type or multiple computers of any appropriate type and interconnected in any appropriate manner, or any combination thereof. Any such logic may be implemented at any single location or at multiple locations that are interconnected in any appropriate manner (e.g., via any type of network).

Additional aspects and advantages of the present invention will become apparent to one skilled in the art upon consideration of the further description that follows. It should be understood that the detailed description and specific examples are intended for purposes of illustration only and are not intended to limit the scope of the invention. Furthermore, any of the above arrangements, features and/or embodiments may be combined with any of the above aspects where appropriate.

DETAILED DESCRIPTION OF THE INVENTION

Figure 1:
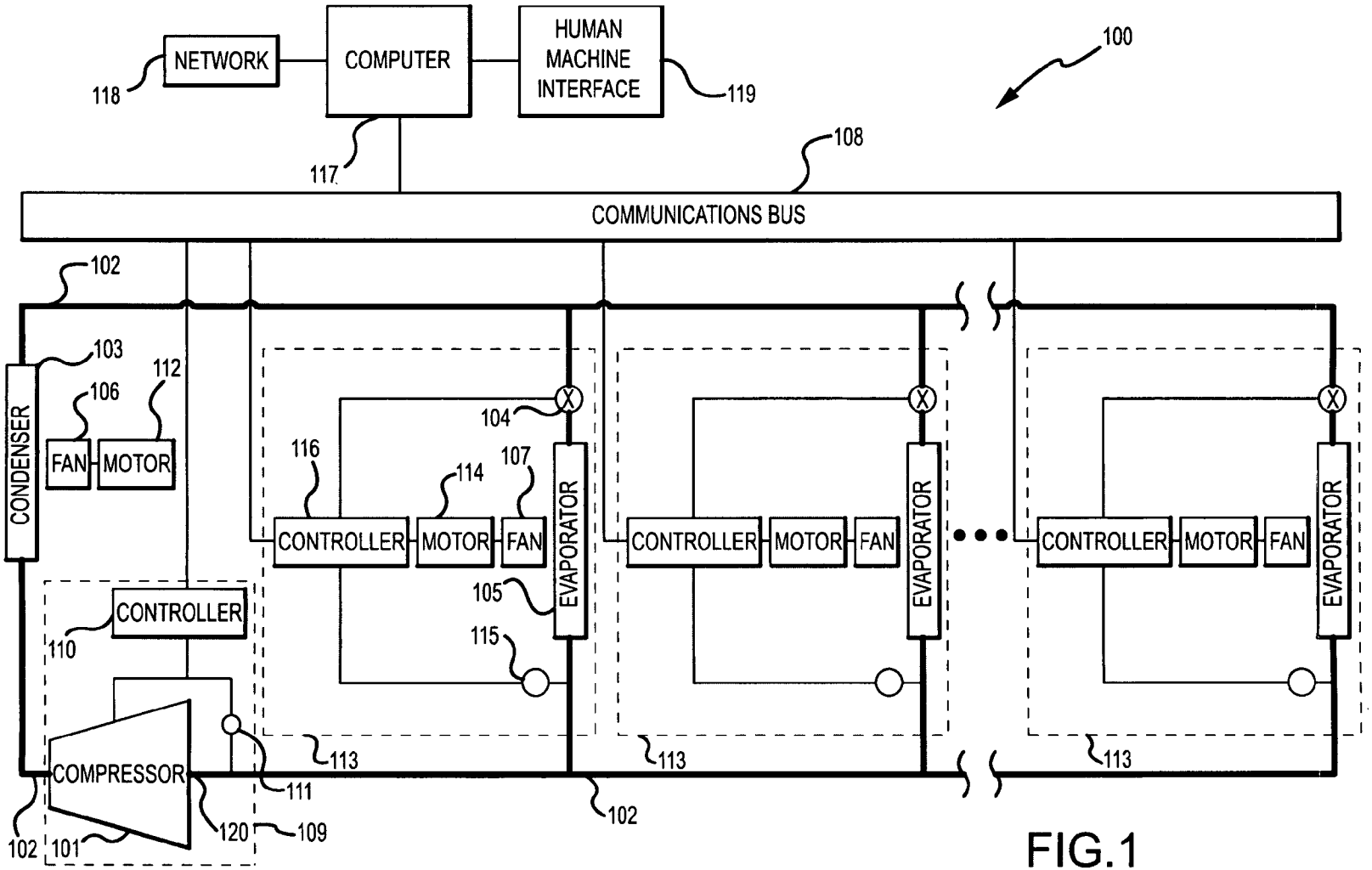
FIG. 1 is a schematic diagram of an embodiment of a vapor compression refrigeration system.

FIG. 1 is a schematic diagram of an embodiment of a vapor compression refrigeration system 100. The vapor compression refrigeration system 100 uses a working fluid (e.g., a refrigerant that undergoes various phase changes while progressing through the system 100) to absorb heat from a space to be cooled. The vapor compression refrigeration system 100 includes a compressor 101, fluid conduits 102 of any appropriate type, a condenser 103, at least one evaporator 105, and an expansion valve 104 or any other device for adjusting one or more operational aspects of the associated evaporator 105.

During operation, working fluid may enter the compressor 101 as saturated vapor. The compressor 101 compresses the working fluid, elevating the working fluid's pressure and temperature. As the working fluid leaves the compressor 101, it may be in the form of superheated vapor.

That superheated vapor may be circulated through the condenser 103 where it is cooled and where it may be condensed into liquid. The working fluid that exits the condenser 103 may be at an elevated pressure. In any case, the condenser 103 may take any appropriate form. The condenser 103 may, for example, be in the form of a coil or plurality of tubes that are cooled by a passing fluid (e.g., outside air). The process of passing the working fluid through the condenser 103 and cooling the working fluid within the condenser 103 rejects heat from the working fluid to the passing fluid (e.g., outside air). Where the passing fluid is air, a condenser fan 106 may direct the passing air over the tubes or coil of the condenser 103. The condenser 103 may be located outside of the area to be cooled, such as outside of a building or room to be cooled. Any appropriate working fluid may be utilized by the condenser 103, and the working fluid may be cooled in any appropriate manner by the condenser 103.

The working fluid, which may now be in the form of condensed liquid, is then circulated through the expansion valve 104 where it undergoes a rapid lowering of pressure that results in the flash evaporation of at least some of the working fluid. The flash evaporation lowers the temperature of the working fluid to where it will typically be colder than the temperature of the space to be cooled. The expansion valve 104 may be adjustable, and the adjustment may be operated by a solenoid, step motor or any other appropriate drive mechanism. The expansion valve 104 may be continuously adjustable or adjustable in selected increments to regulate the flow rate of the working fluid to the evaporator 105.

The working fluid, which may now be in the form of a combination of liquid and vapor, is then circulated through the evaporator 105 located in the space to be cooled. The evaporator 105 may take any appropriate form, for instance in the form of a coil or plurality of tubes that are operable to cool (i.e., absorb heat from) passing air within the space to be cooled. This process removes heat from the space to be cooled. An evaporator fan 107 may direct air over the tubes or coil of the evaporator 105. As the working fluid absorbs heat from the passing air, the liquid portion of the working fluid evaporates. After passing through the evaporator 105, the working fluid, which may now be in the form of superheated vapor, is circulated back to the compressor 101 to complete the refrigeration cycle.

The vapor compression refrigeration system 100 may utilize any appropriate number of compressors 101 and condensers 103, including one or more compressors 101, one or more condensers 103, or both. The vapor compression refrigeration system 100 may also utilize any appropriate number of evaporators 105. The above-described components (compressor 101, condenser 103, expansion valve 104, and evaporator 105) are common to most vapor compression refrigeration systems. Each compressor 101 would have one or more associated condensers 103 disposed in any appropriate arrangement, one or more associated evaporators 105 disposed in any appropriate arrangement, or both.

The vapor compression refrigeration system 100 of FIG. 1 may further include a communications bus 108 of any appropriate type. The communications bus 108 may serve as a means for communications between various components of the vapor compression refrigeration system 100. The communications bus 108 may facilitate any appropriate communications protocol including, but not limited to, a custom communications protocol, the Modbus® serial communications protocol or a modification thereof, or transmission control protocol (TCP). In the case where the vapor compression refrigeration system 100 utilizes multiple compressors 101, each such compressor 101 may have one or more dedicated evaporators 105, although all communications between each compressor 101 and its dedicated evaporators 105 may utilize a common communications bus 108.

The vapor compression refrigeration system 100 may include a compressor subsystem 109. The compressor subsystem 109 may include the above-noted compressor 101, a compressor subsystem controller 110 and a compressor inlet sensor 111. Although a single compressor subsystem 109 is illustrated in FIG. 1, the vapor compression refrigeration system 100 may include additional compressor subsystems 109 in accordance with the foregoing. The compressor 101 may comprise a variable frequency drive to vary the speed of the compressor 101. The speed of the compressor 101 may be varied to match the compressor 101 capacity to the current system load ("current system load" being the heat load of the space to be cooled). Matching compressor 101 capacity to system load may result in increased vapor compression refrigeration system 100 efficiency. Furthermore, the vapor compression refrigeration system 100 may incorporate floating discharge and suction pressure control at the compressor 101 to further increase the vapor compression refrigeration system 100 efficiency. Reducing the difference between compressor 101 suction pressure and compressor 101 discharge pressure may result in a lower amount of work required to be performed by the compressor 101, and therefore should increase efficiency. It is noted that, for any given compressor 101 suction pressure, the working fluid entering the compressor 101 is desired to be entirely vapor (e.g., superheated vapor) to reduce the potential for damage to the compressor 101 by the working fluid.

The compressor inlet sensor 111 may be operable to measure or monitor one or more aspects of the working fluid at or near a compressor inlet 120 (compressor suction). The measurements made by the compressor inlet sensor 111 may enable the degree of superheat of the working fluid entering the compressor 101 to be determined. For example, the compressor inlet sensor 111 may include a pressure transducer and temperature sensor. In this regard, when the pressure and temperature of the working fluid are known at or near the compressor inlet 120, the degree of superheat in the working fluid at the compressor inlet 120 may be determined.

It should be noted that the superheat level at the compressor inlet 120 may be different from the superheat level at the outlet of each associated evaporator 105. For instance, the compressor 101 and each of its corresponding evaporators 105 may be spaced by a relatively significant distance. Therefore, the compressor inlet sensor 111 should be located to provide an accurate representation of the superheat level at the compressor inlet 120. In one embodiment, the superheat level is based upon data acquired at a point about 12 inches from the compressor inlet 120. The position of the compressor inlet sensor 111 along the circumference of a cross-section of the working fluid line 102 (at the point about 12 inches from the compressor inlet 120) may, for example, be at about a four o'clock or at about an eight o'clock position (with the six o'clock position being the lowermost point along the circumference and the twelve o'clock position being the uppermost point). In one embodiment, the superheat level is based upon data acquired within about 12 inches of the compressor inlet 120 (and thereby encompassing using data acquired from within the compressor inlet). Another characterization is that the superheat of the working fluid is determined at or near the compressor inlet 120, as well as at the outlet of each associated evaporator 105. In one embodiment, the superheat level that is used to initiate an adjustment of the operation of each associated evaporator 105 is the superheat level that is closest to the compressor inlet 120.

Both the compressor 101 and the compressor inlet sensor 111 may be communicatively interconnected to the compressor controller 110. The compressor controller 110 may also be communicatively interconnected to the communications bus 108. In this regard, the compressor controller 110 may be operable to communicate with various other components of the vapor compression refrigeration system 100 through the communications bus 108. In an embodiment, the compressor controller 110 may be a slave controller operable to communicate via master-to-slave and/or slave-to-slave communication protocols via the communications bus 108. The compressor controller 110 may be operable to determine the compressor inlet 120 superheat level and generate signals to control other components of the vapor compression refrigeration system 100. The signals may be communicated via the communications bus 108 and are discussed below with reference to FIGS. 2 and 3.

In an alternate embodiment, the functions described as being performed by the compressor subsystem controller 110 may be performed by one or more discrete controllers. For example, a first controller may control various functions of the compressor 101 and a second controller may determine superheat at the inlet to the compressor 101 and generate vapor compression refrigeration system 100 control signals based on the determined superheat levels.

The condenser 103 of the vapor compression refrigeration system 100 may be of any appropriate configuration. For example, the condenser 103 may comprise tubing for the flow of the working fluid where the tubing is arranged in a serpentine manner and interconnected to heat dissipation members such as honeycombed sheet metal. The fan 106 may drive a stream of air over the condenser 103 to aid in the transfer of heat from the condenser 103. A condenser controller (not shown) may be interconnected to a condenser motor 112 and various sensors (not shown) associated with the condenser 103. The condenser controller may be communicatively interconnected to the communications bus 108. The vapor compression refrigeration system 100 may include a single condenser 103 or it may include a plurality of condensers 103. The condenser 103 may include an outside air temperature sensor.

The vapor compression refrigeration system 100 may include an evaporator subsystem 113. Any appropriate number of evaporator subsystems 113 may be utilized by the vapor compression refrigeration system 100, including a single evaporator subsystem 113 or multiple evaporator subsystems 113. Multiple evaporator subsystems 113 may be disposed in any appropriate arrangement (e.g., in parallel as shown). The evaporator subsystems 113 may all be disposed in a single space to be cooled or the evaporator subsystems 113 may be disposed in a plurality of separate spaces to be cooled, with each of the plurality of spaces containing one or more of the evaporator subsystems 113. Each evaporation subsystem 113 may be of a common configuration, and therefore reference will be made to one such configuration.

The evaporator subsystem 113 may include the expansion valve 104, the fan 107 and an associated evaporator fan motor 114, and an evaporator output sensor 115. The evaporator subsystem 113 may further include an evaporator subsystem controller 116 operatively interconnected to other components (e.g., the expansion valve 104, the fan motor 114, the evaporator output sensor 115) of the evaporator subsystem 113. Furthermore, the evaporator subsystem controller 116 may be communicatively interconnected to the communications bus 108. In an embodiment, the evaporator controller 116 may be a slave controller operable to communicate via master-to-slave and/or slave-to-slave communication protocols via the communications bus 108. Furthermore, the evaporator subsystem 113 may include a temperature sensor (not shown) operable to measure the ambient air temperature within the space to be cooled.

The evaporator output sensor 115 may be operable to measure one or more aspects of or monitor the working fluid at or near the exit or outlet of the evaporator 105. The measurements made by the evaporator output sensor 115 may enable the degree of superheat of the working fluid exiting the evaporator 105 to be determined. For example, the evaporator output sensor 115 may include a pressure transducer and temperature sensor. Alternatively, the evaporator output sensor 115 may be a temperature sensor and the evaporator subsystem 113 may include a second temperature sensor (not shown) disposed at the inlet of the evaporator 105. In such a configuration, the superheat at the exit of the evaporator 105 may be determined by inlet and evaporator output 115 temperature sensors. The temperature difference across the evaporator 115 corresponds to the level of superheat in the working fluid at the exit or outlet of the evaporator 105. In any case and for the vapor compression refrigeration system 100, the superheat may be determined at the compressor inlet 120 and at the evaporator outlet of each associated evaporator 105.

The vapor compression refrigeration system 100 may further include a computer 117 communicatively interconnected to the communications bus 108. The computer 117 may be operable to operate as a master computer in communications with, and operable to control, other devices interconnected to the communications bus 108. The computer 117 may be operable to perform control, communication, human interface, fault detection, or any other appropriate function. For example, the computer 117 may be operable to receive inputs from a user, such as temperature settings for spaces to be cooled, and send corresponding control signals to the appropriate components of the vapor compression refrigeration system 100 to attempt to achieve those temperatures.

The computer 117 may be operable to receive and store data from other devices interconnected to the communications bus 108. Such storage may be achieved by a data storage module (e.g., memory, hard drive) of the computer 117. The computer 117 may also be operable to act as a web server enabling communication with the vapor compression refrigeration system 100 over a network 118. The network 118 may be the Internet or any other appropriate network. Using these capabilities, a user may be capable of remotely contacting the computer 117 (e.g., over the Internet with a remote computer or wireless device) and downloading from the computer 117 data regarding the condition and performance (e.g., past and/or present) of the vapor compression refrigeration system 100. Furthermore, the user may be able to remotely adjust parameters and control various components of the vapor compression refrigeration system 100 remotely through the network 118 and computer 117.

The computer 117 may also include or be connected to one or more human machine interfaces 119, such as touch screens and/or control panels (e.g., more generally one or more data entry devices), for direct local control of the vapor compression refrigeration system 100. For example, a human machine interface 119 may be located in or near each space to be cooled by the vapor compression refrigeration system 100. The human machine interface 119 may include a customizable display operable to display various user selected operational parameters of the vapor compression refrigeration system 100.

The computer 117 may be in the form of a personal computer and appropriate components (e.g., embedded web server, cards, control modules, peripherals). The computer 117 may be in the form of dedicated industrial controller. Such a dedicated industrial controller may comprise a housing containing components to interface with and control various components of the vapor compression refrigeration system 100. The industrial controller may include an embedded web server for remote communications and/or control. The industrial controller may include the human machine interface 119 in the form of, for example, a touch screen mounted to the housing, alone or in combination with one or more other data entry devices (e.g., keyboard, mouse). Alternatively, the computer 117 may be comprised of a plurality of separate devices (e.g., stand-alone controllers, communication gateways, human machine interfaces) interconnected to each other and/or the communications bus 108.

As noted, the vapor compression refrigeration system 100 may include a plurality of evaporator subsystems 113. The vapor compression refrigeration system 100 may also include a plurality of compressor subsystems 109 and/or a plurality of condensers 103. Although a single communications bus 108 is illustrated, the communications bus 108 may be of any appropriate form that accommodates the communications or operative interconnections described herein. One or more communication technologies could be used by the vapor compression refrigeration system 100 and may be collectively encompassed by the communications bus 108. For example, the components may communicate via a wireless network, a local area network, via any other appropriate communication network, or any combination thereof. The devices may communicate using the Modbus® protocol, TCP, and/or any other appropriate protocol.

Figure 2:
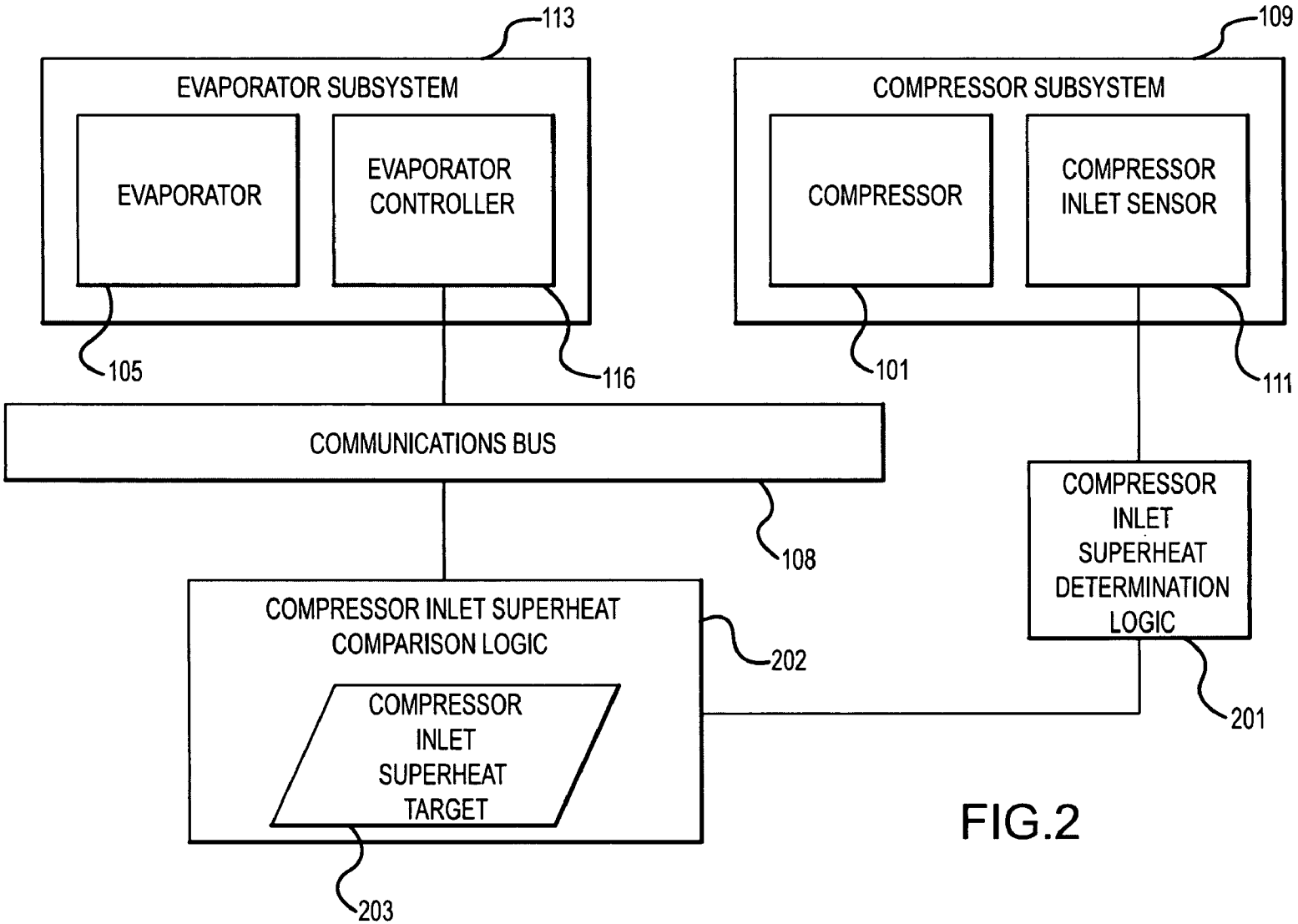
FIG. 2 is a block diagram of an embodiment of logic or control functionality that may be utilized by the vapor compression refrigeration system of FIG. 1.

FIG. 2 is a block diagram of an embodiment of logic or control functionality that may be utilized by the vapor compression refrigeration system 100 of FIG. 1. That is, the block diagram illustrates representative communications and control logic that may be utilized by the vapor compression refrigeration system 100. The communications and control logic may be operable to be used in conjunction with the methods described below. Any logic that is utilized by the vapor compression refrigeration system 100 may be implemented in any appropriate manner, including without limitation in any appropriate software, firmware, or hardware, using one or more platforms, using one or more processors, using memory of any appropriate type, using any single computer of any appropriate type or multiple computers of any appropriate type and interconnected in any appropriate manner, or any combination thereof. Any such logic may be implemented at any single location or at multiple locations that are interconnected in any appropriate manner (e.g., via any type of network).

A compressor inlet superheat determination module or logic 201 may be in communication with the compressor inlet sensor 111 of the compressor subsystem 109. The compressor inlet superheat determination logic 201 may be operable to determine a superheat value for the working fluid entering the compressor inlet 120. For example, the compressor inlet sensor 111 may be comprised of a pressure transducer and temperature sensor operable to measure the pressure and temperature of the working fluid. The outputs of the sensors may be communicated to the compressor inlet superheat determination logic 201. The superheat of the working fluid as it enters the compressor inlet 120 may be determined by the compressor inlet superheat determination logic 201 using any appropriate methodology based on any appropriate sensor reading by the compressor sensor 111. For example, the compressor inlet superheat determination logic 201 may calculate a superheat value based on one or more measured inputs (e.g., pressure and temperature), one or more known properties of the working fluid, or any combination thereof. Alternatively, the compressor inlet superheat determination logic 201 may use a lookup table to determine the superheat of the working fluid.

The compressor inlet superheat determination logic 201 may be implemented in any appropriate manner and may be disposed in any appropriate location. For example, the compressor inlet superheat determination logic 201 may be embedded in the compressor subsystem controller 110 of the associated compressor subsystem 109. In another example, the compressor inlet superheat determination logic 201 may be incorporated by the computer 117. In yet another example, the compressor inlet superheat determination logic 201 may be incorporated by a stand-alone device or module.

A compressor inlet superheat comparison module or logic 202 may be operable to compare the level of superheat at the compressor inlet 120, as determined by the compressor inlet superheat determination logic 201, to a compressor inlet superheat target 203. This comparison may be undertaken in any appropriate manner. The compressor inlet superheat target 203 may be in any appropriate form. For example, the compressor inlet superheat target 203 may be a predeterminable value with an associated acceptable range of variation (e.g., 15 degrees Fahrenheit (F.) plus or minus one degree F.; 15 degrees F., with an acceptable variance of 10%). For example, the compressor inlet superheat target 203 may be a range (e.g., 15 to 17 degrees F.). The compressor inlet superheat target 203 may be a preprogrammed value and/or it may be adjustable by a user. The compressor inlet superheat target 203 may be a fixed target, or it may be a variable target, for example, based on ambient conditions surrounding the condenser 103 and/or conditions within the space to be cooled. The compressor inlet superheat target 203 may be of any appropriate value or range of values, and may be made available to the compressor inlet superheat comparison logic 202 in any appropriate manner.

The compressor inlet superheat comparison logic 202 may be used to control operation of the evaporator 105 of one or more of the evaporator subsystems 113. The compressor inlet superheat comparison logic 202 may be operable to generate a new or updated evaporator outlet superheat target for the working fluid being discharged from one or more evaporator subsystems 113 coupled to the vapor compression refrigeration system 100, where this new or updated evaporator outlet superheat target is based upon the comparison provided by the logic 202. The new evaporator outlet superheat target may be in the form of a new evaporator outlet superheat target value and/or a level of change to an existing evaporator outlet superheat target value.

In either case (new evaporator outlet superheat target determination or evaporator outlet superheat target change level determination), the value determined by the compressor inlet superheat comparison logic 202 may be communicated to the evaporator subsystems 113 via an interconnection to the communications bus 108.

Consider the case where the difference between the determined superheat level and the compressor inlet superheat target 203 is 1 degree F. of superheat (too low) and the previous superheat target for the evaporator 105 was 10 degrees F. of superheat. The new evaporator outlet superheat target for the evaporator 105 may be 11 degrees F. (1 degree F. plus 10 degrees F.). This new evaporator outlet superheat target may be communicated to the evaporator subsystem 113. Alternatively, a change value for the evaporator outlet superheat target may be calculated. For example, using the figures from the immediately preceding example, the change value may be positive 1 degree F. of superheat. Accordingly, the change value may be communicated to the evaporator subsystem 113, which would in turn increment its evaporator outlet superheat target by 1 degree F.

Generally, the compressor inlet superheat comparison logic 202 may send a signal (via the communications bus 108) to one or more of the evaporator subsystems 113, where this signal embodies information as to how operation of the evaporator subsystem(s) 113 should be adjusted in relation to an associated evaporator outlet superheat.

The compressor inlet superheat comparison logic 202 may be implemented in any appropriate manner and may be disposed in any appropriate location. For example, the compressor inlet superheat comparison logic 202 may be embedded in the compressor subsystem controller 110 of the compressor subsystem 109. Another option is for the compressor inlet superheat comparison logic 202 to be incorporated by the computer 117. In another example, the compressor inlet superheat determination logic 202 may be incorporated by a stand-alone device or module. The compressor inlet superheat determination logic 202 may be interconnected to the communications bus 108.

The compressor inlet superheat comparison logic 202 may be operable to broadcast to one or more of the evaporator subsystems 113, where each evaporator subsystem 113 receives information on a new or updated evaporator outlet superheat target value and adjusts accordingly. The broadcast may be in the form of slave-to-slave communications, where the compressor inlet superheat comparison logic 202 sends the new evaporator outlet superheat target value onto the communications bus 108. Such a signal may include an identifier to identify the compressor subsystem 109 associated with the new evaporator outlet superheat target value. This may be advantageous in vapor compression refrigeration systems 100 containing more than one compressor, where certain evaporators are associated with certain compressor subsystems 109. In such a system, each evaporator subsystem 113 may be programmed to only act upon new evaporator outlet superheat target values broadcasted from a specific, associated compressor subsystem 109. In this regard, the evaporator subsystem 113 may be operable to selectively ignore a broadcast of an evaporator outlet superheat target value from an unselected source, such as an unassociated compressor subsystem 109.

In response to receiving a new evaporator outlet superheat target value from the compressor inlet superheat comparison logic 202, the evaporator subsystems 113 may each adjust their associated expansion valves 104, their associated fan motors 114, or any other appropriate operational parameter such that the level of superheat at the discharge of the evaporator subsystems 113 is adjusted in an attempt to realize the new superheat target value.

In summary, the compressor inlet superheat comparison logic 202 may identify a need to adjust the outlet superheat of the evaporator 105 of one or more evaporator subsystems 113. Any appropriate communication may be sent by the compressor inlet superheat comparison logic 202 to one or more evaporator subsystems 113. For instance, the communication from the compressor inlet superheat comparison logic 202 could be in the form of a control signal, which would modify the operation of the associated evaporator subsystem 113 and its associated evaporator 105 accordingly. The communication from the compressor inlet superheat comparison logic 202 could also be used by an evaporator controller 116 to determine how operation of its associated evaporator 105 should be adjusted (e.g., the communication from the compressor inlet superheat comparison logic 202 could be to provide an evaporator outlet superheat target, and the evaporator controller 116 could determine how one or more parameters should be adjusted to realize such an evaporator outlet superheat target; the communication from the compressor inlet superheat comparison logic 202 could be to provide an incremental adjustment of the current evaporator outlet superheat, and the evaporator controller 116 could determine how one or more parameters should be adjusted to realize such an incremental adjustment). In any case, the compressor inlet superheat comparison logic 202 is used to in effect control operation of the evaporator 105 of one or more evaporator subsystems 113.

Figure 3:
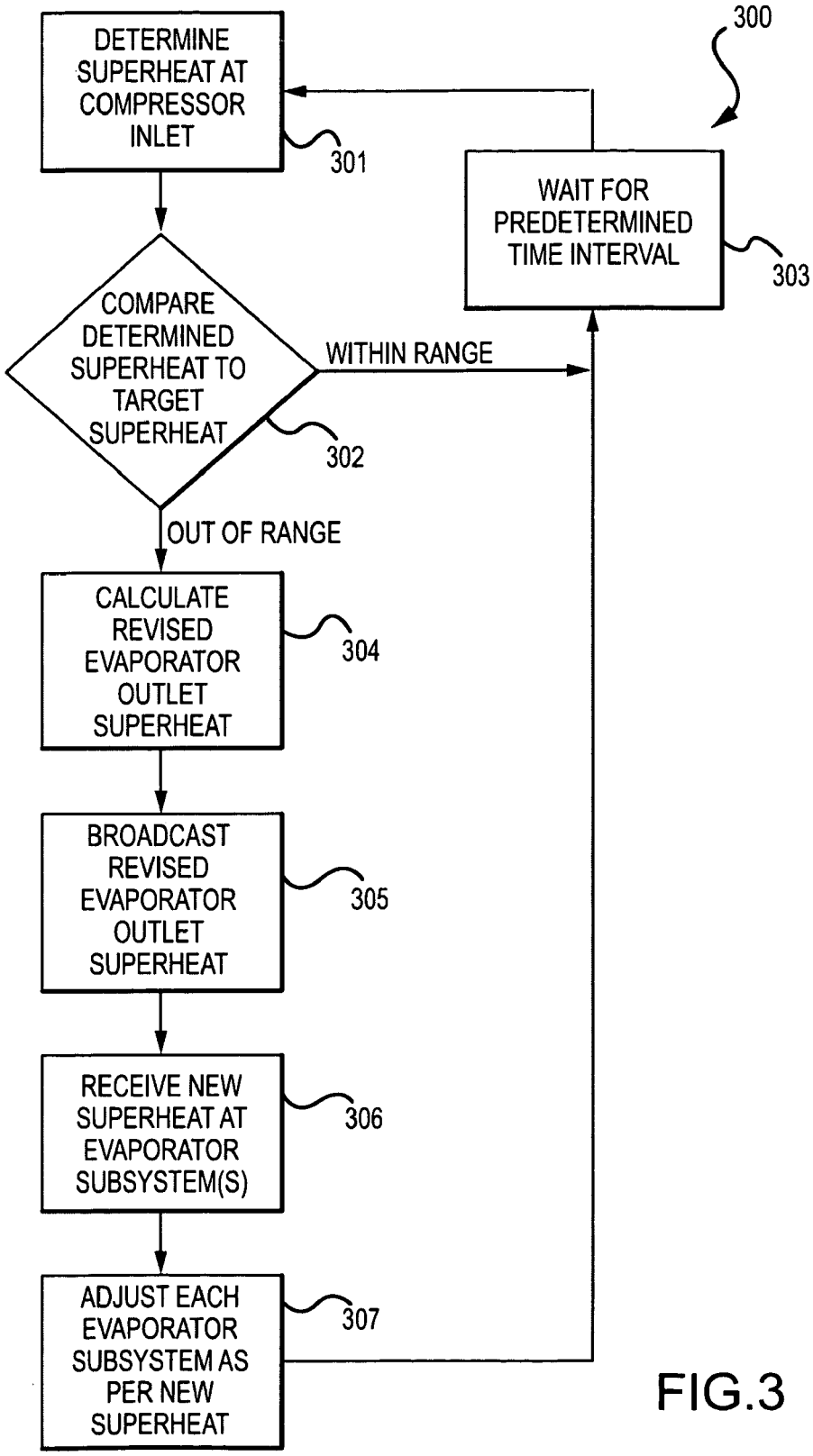
FIG. 3 is a flow chart of an embodiment of a protocol for operating the vapor compression refrigeration system of FIG. 1.

FIG. 3 is a flow chart of an embodiment of a protocol 300 for operating a vapor compression refrigeration system 100 (e.g., "operations protocol 300"). In general, the methodologies described herein are intended to yield increased system efficiencies while achieving a particular goal (e.g., cooling a defined space to a targeted temperature) using reduced amounts of inlet power (e.g., electricity).

One method of achieving increased efficiency is to reduce the differential between the suction pressure and discharge pressure of the compressor 101, thereby reducing the amount of work performed by the compressor 101. For example, in general, a high suction pressure and a low discharge pressure at the compressor 101 may result in increased efficiency of the compressor 101. The vapor compression refrigeration system 100 may employ floating discharge and suction pressures at the compressor 101 to increase efficiency. Furthermore using a compressor 101, such as a variable frequency drive compressor, whose capacity can be varied to match current load conditions, may further increase the efficiency.

To achieve increased efficiency through evaporator 105 control, it may be beneficial to generally operate the evaporator 105 such that the working fluid leaving the evaporator 105 contains a relatively low amount of superheat. In this regard, evaporator 105 operation is more efficient when the evaporator 105 is used to convert liquid working fluid into vapor working fluid. Any capacity of the evaporator 105 that is used to not convert liquid to vapor, but to increase the temperature of the vapor (e.g., increase the superheat of the vapor) is not being used as efficiently as evaporator 105 capacity used to convert liquid to vapor. Accordingly, theoretically to achieve an increased level of evaporator 105 efficiency, the level of superheat at the discharge of the evaporator 105 may be near zero. However, near zero superheat may result in a portion of the working fluid being in the form of liquid. If a portion of the working fluid is liquid as it enters the compressor 101, damage to the compressor 101 may result. Therefore, the level of superheat discharged from the evaporator 105 may be selected to be the minimum value at which no liquid working fluid should enter the compressor 101, plus any safety margin above the minimum level that may be desired.

The safety margin for the amount of superheat in the working fluid discharged from the evaporator 105 may be selected based on several factors. For example, generally the safety the margin may be selected such that typical variations in ambient conditions (e.g., where the condenser 103 is typically disposed) and loads will not cause the level of superheat at the compressor inlet 120 to be below the selected minimum value. Ambient condition variations may include, for example, daily temperature and humidity changes due to the rising and setting of the sun and changes due to changes in weather. The safety margin for the amount of superheat in the working fluid discharged from the evaporator 105 may, for example, additionally be selected based on expected load variations and/or the ability of the evaporator subsystem controller 116 to maintain superheat level control (generally, evaporator superheat level control is more difficult at lower superheat levels). In an example, the superheat in the working fluid discharged from the evaporator 105 may be maintained above a minimum level of about six degrees of superheat and below a maximum level of about fifteen degrees of superheat. Generally, the vapor compression refrigeration system 100 may be operated such that the superheat in the working fluid discharged from the evaporator 105 may be as low as possible within the above operational window (i.e., six to fifteen degrees of superheat) while maintaining a superheat level at the compressor inlet 120. However, for a particular operational situation, if a higher superheat level in the working fluid discharged from the evaporator 105 is needed to maintain a minimum desired superheat level at the compressor inlet 120, the above-noted maximum level of superheat in the working fluid discharged from the evaporator 105 may be exceeded.

In some prior art systems, the setting of the level of superheat in the working fluid at the discharge from an evaporator may be manually adjusted on a seasonal basis to account for seasonal changes in the ambient conditions. The setting of the level of superheat in the working fluid at the discharge from an evaporator in prior art systems may need to account for significant day-to-day changes in ambient conditions and system loads. Such changes may result in superheat levels at the compressor inlet 120 of prior art systems varying within a window of 10 to 15 degrees of superheat or more.

Returning to the vapor compression refrigeration system 100 and the protocol 300 of FIG. 3, variations in ambient conditions surrounding the working fluid lines 102 between various components may lead to variations. For example, changes in superheat levels of the working fluid may occur between the discharge of the evaporator 105 and the compressor inlet 120. Such variations in prior art systems are generally compensated for by the aforementioned prior art safety margin. Such variations may cause a gain or loss in the level of superheat between the discharge of the evaporator 105 and the compressor inlet 120. This is particularly pronounced on larger refrigeration systems, where the distance between the evaporator 105 and compressor 101 may be significant. In prior art systems, compressor manufacturers generally recommend that the inlet to the compressor has a minimum of 15 degrees F. of superheat to insure that no liquid enters into the compressor (during operation, such prior art systems may reach superheat levels at the compressor inlet of 30 degrees F. or more). The systems and methods described herein may be operable to safely work (e.g., have a low chance of liquid working fluid entering the compressor 101) at compressor inlet 120 superheat levels of, for example, between 15 and 25 degrees F. of superheat. The systems and methods may be operable to maintain the compressor inlet 120 superheat level within a 2 degree F. window disposed about a particular superheat value. Accordingly, the vapor compression refrigeration system 100 may be operable to be advantageously operated with a compressor inlet 120 superheat level of between about 15 and 17 degrees F. of superheat. Lower compressor inlet 120 superheat target levels may be utilized.

The operations protocol 300 for the vapor compression refrigeration system 100 illustrated in FIG. 3 provides control of superheat levels at the evaporator(s) 105 and at the compressor inlet 120. In this regard, the control allows reduced superheat at the discharge of the evaporator(s) 105 while operating the compressor 101 within acceptable safety margins (e.g., with respect to the possibility of liquid working fluid entering the compressor 101). This in turn yields increased efficiency of the vapor compression refrigeration system 100. The operations protocol 300 may be operable to compensate for changes in ambient conditions and load conditions, and may also compensate for conditions that may lead to variations in the superheat level between the discharge of the evaporator(s) 105 and the compressor inlet 120.

The operations protocol 300 will be described with reference to a single evaporator subsystem 113. However, it should be understood that the described protocol 300 may also apply to systems comprising a plurality of evaporator subsystems 113. A first step 301 may be to determine an amount of superheat at the compressor inlet 120. The amount of superheat at the compressor inlet 120 may be determined in any appropriate manner, for instance using the compressor inlet sensor 111 and the compressor inlet superheat determination logic 201 in accordance with the foregoing.

The next step 302 in the protocol 300 may be to compare the determined superheat level to the compressor inlet superheat target 203. The compressor inlet superheat target 203 may be based on the variations in the superheat at the compressor inlet 120 expected when executing the protocol 300. If the determined superheat is acceptable, the next step 303 may be to wait for a predetermined time interval and then return to step 301. Any time interval may be utilized for purposes of step 303 (e.g., periodic; in accordance with a predetermined schedule, where all or part of this schedule may be periodic, where all or part of this schedule may be non-periodic, or a combination thereof).

If in step 302, the determined superheat is unacceptable (e.g., outside of an acceptable range; out of compliance with the target superheat), the next step 304 may be to calculate a revised evaporator superheat value for the evaporator 105. For example, if the level of superheat at the compressor inlet 120 has exceeded a set amount, a new lower evaporator superheat target for the evaporator 105 may be calculated. Such a new evaporator superheat target for the evaporator 105 may be determined from the difference between the determined superheat level and the target compressor inlet 120 superheat level and a previous superheat value for the evaporator 105. The new evaporator superheat target may be expressed as a new evaporator superheat level or a superheat change value.

The next step 305 may be to broadcast the new evaporator superheat level or superheat change value to the evaporator subsystem 113. This may be followed by step 306 of receiving the new evaporator superheat level or the superheat change value at the evaporator subsystem 113. This sending and receiving may occur over the communications bus 108. The broadcast of the new evaporator superheat level or superheat change value may be by the compressor subsystem 109 configured as a slave and the communications with the evaporator 105 may be via slave-to-slave communication protocols. The broadcast of the new evaporator superheat level or superheat change value may be by the compressor subsystem 109 and may include an identifier identifying the particular compressor subsystem 109 that broadcasted. The evaporator subsystem 113 may be configured to only act upon communications received over the communications bus 108 from a particular compressor subsystem 109. In this manner, systems with multiple compressor subsystems 109 and multiple evaporators 113 communicatively interconnected to the communications bus 108 may be accommodated.

In the next step 307, the evaporator subsystem 113 may make adjustments to attempt to produce or meet the evaporator superheat target, and therefore the new compressor inlet superheat target. For example, the evaporator subsystem 113 may adjust the expansion valve 104 to lower or increase the level of superheat at the discharge from the evaporator subsystem 113. In another example, the evaporator subsystem 113 may increase or decrease the fan 107 speed associated with the evaporator subsystem 113. The evaporator subsystem 113 may adjust both the expansion valve 104 and the fan 107 speed. Furthermore, any other appropriate adjustment may be made. In performing the adjusting step, the evaporator subsystem 113 may make measurements of the level of superheat at the discharge of the evaporator 105 with the evaporator output sensor 115. In this regard, the evaporator subsystem 113 may be completely self-contained in that it is able to receive a target evaporator superheat level signal from the compressor subsystem 109 and then independently achieve the target evaporator superheat level without further external control.

The next step may be step 303 where the vapor compression refrigeration system 100 waits for the predetermined time interval before making another determination of the superheat at the compressor inlet 120. The time interval of step 303 may be preset and/or selected by a user. By way of example only, the time interval may be one minute, five minutes, one hour, or any other appropriate time interval. The time interval may be determined by several factors including, processor speed, expected rapidity of ambient and/or load condition changes, vapor compression refrigeration system 100 change response time, and vapor compression refrigeration system 100 stability. In an embodiment, the time interval may be zero, in which case the vapor compression refrigeration system 100 may make continuous superheat determinations at the compressor inlet 120 and continuous alterations to the evaporator subsystem 113 as needed.

Along with performance of the current protocol 300, other efficiency-increasing measures may be taken including, but not limited to, floating compression discharge and suction pressures as discussed above and varying compressor 101 capacity to match the current load. Other parameters of the vapor compression refrigeration system 100 may also be varied, such as condenser fan 106 speed.

The above-described apparatuses, protocols and methods, enable the vapor compression refrigeration system 100 to safely operate with less superheat in the working fluid at the outlet of the evaporator 105 than prior art systems. As a result, higher efficiencies in evaporator 105 operation may be achieved. The ability to operate with less superheat in the working fluid at the outlet of the evaporator 105 may be a result of tighter control of the level of superheat in the working fluid at the inlet 120 of the compressor 101 than in prior art systems. The tighter control of the level of superheat in the working fluid at the inlet 120 of the compressor 101 may be a result of using measurements made at the inlet to the compressor 101 to periodically or continuously adjust superheat levels at the outlets of the associated evaporator 105. Such frequency of adjustments may enable the vapor compression refrigeration system 100 to react to changes in ambient conditions, system load, system performance, and other factors.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A vapor compression refrigeration system comprising:

a communications bus;

a plurality of evaporator subsystems, each comprising:

an evaporator, an evaporator controller communicatively attached to said communications bus, an expansion valve controlled by said evaporator controller, and an evaporator discharge sensor interconnected to said evaporator controller, wherein said evaporator discharge sensor measures evaporator discharge superheat;

a compressor;

a compressor inlet sensor that takes a measurement at a compressor inlet, wherein a compressor inlet superheat level may be determined from said measurement;

a compressor controller communicatively attached to said communications bus, wherein said compressor controller broadcasts an evaporator superheat target to said plurality of evaporator subsystems, wherein said compressor controller determines said evaporator superheat target at least partially based on said compressor inlet superheat level and a target inlet superheat for said compressor; and a condenser.

2. The vapor compression refrigeration system of claim 1, wherein each of said plurality of evaporator subsystems comprises a variable speed fan.

3. The vapor compression refrigeration system of claim 1, wherein each of said plurality of evaporator controllers selectively ignores a broadcast of a superheat output set point from an unselected source, wherein said unselected source is an additional compressor controller communicatively attached to said communications bus.

4. The vapor compression refrigeration system of claim 1, wherein each of said plurality of evaporator controllers and said compressor controllers are slave controllers.

5. The vapor compression refrigeration system of claim 4, further comprising a master computer communicatively attached to said communications bus, wherein said master computer receives and stores data from said slave controllers.

6. The vapor compression refrigeration system of claim 1, wherein said compressor is a variable capacity compressor.

7. The vapor compression refrigeration system of claim 1, wherein said compressor inlet sensor includes a pressure transducer and a temperature measurement device.

8. A vapor compression refrigeration system comprising: a communications bus; an evaporator subsystem comprising an evaporator and an evaporator controller, wherein said evaporator controller is in operative communication with said communications bus; a compressor subsystem comprising a compressor and a compressor inlet sensor; a compressor inlet superheat determination logic operatively interconnected with said compressor inlet sensor and that determines a compressor inlet superheat level; and a compressor inlet superheat comparison logic operatively interconnected with said compressor inlet superheat determination logic and comprising a compressor inlet superheat target, wherein said compressor inlet superheat comparison logic is in operative communication with said evaporator controller through said communications bus, wherein said compressor inlet superheat comparison logic generates an evaporator outlet superheat target based on said compressor inlet superheat level and said compressor inlet superheat target.

9. The vapor compression refrigeration system of claim 8, further comprising at least one additional evaporator subsystem, wherein each of said at least one additional evaporator subsystems comprises:

an evaporator; and an evaporator controller in operative communication with said communications bus.

10. The vapor compression refrigeration system of claim 8, further comprising:

a data storage module in operative communication with said evaporator controller and said compressor subsystem through said communications bus, wherein said data storage module contains operational parameters obtained from said evaporator controller and said compressor subsystem; and a web server module operatively interconnected to said data storage module.

11. The vapor compression refrigeration system of claim 1, wherein said evaporator superheat target is not equal to said target inlet superheat for said compressor.

* * * * *